US005167409A

United States Patent [19]

Higeta

[11] Patent Number: 5,167,409

[45] Date of Patent: Dec. 1, 1992

[54] APPARATUS AND METHOD FOR ALIGNING A SHEET AGAINST A SIDE REGISTRATING MEMBER USING PLURAL ALIGNMENT DEVICES

[75] Inventor: Akira Higeta, Yokohama, Japan

[73] Assignee: Canon Kabushiki Kaisha, Tokyo, Japan

[21] Appl. No.: 832,657

[22] Filed: Feb. 11, 1992

Related U.S. Application Data

[63] Continuation of Ser. No. 436,031, Nov. 14, 1989, abandoned.

[30] Foreign Application Priority Data

Nov. 15, 1988 [JP] Japan ..... 63-286825

[51] Int. Cl.[5] ..... B65H 5/00

[52] U.S. Cl. ..... 271/225; 271/251; 355/319

[58] Field of Search ..... 271/225, 240, 250, 251; 355/318, 319

[56] References Cited

U.S. PATENT DOCUMENTS

| | | | |
|---|---|---|---|
| 3,666,262 | 5/1972 | Fowler et al. | 271/251 |
| 3,929,327 | 12/1975 | Olson | 271/250 |
| 4,098,551 | 7/1978 | Komori et al. | 355/3 R |
| 4,374,586 | 2/1983 | Lamos et al. | 271/37 |
| 4,877,234 | 10/1989 | Mandel | 271/225 |
| 4,955,965 | 9/1990 | Mandel | 271/251 X |

FOREIGN PATENT DOCUMENTS

| | | | |
|---|---|---|---|
| 113641 | 9/1981 | Japan | 271/250 |
| 90344 | 6/1982 | Japan | 271/251 |
| 26741 | 2/1983 | Japan | 271/250 |
| 31844 | 2/1983 | Japan | 271/251 |
| 109344 | 6/1983 | Japan | 271/250 |
| 109345 | 6/1983 | Japan | 271/250 |
| 114248 | 7/1984 | Japan | 271/251 |
| 136454 | 6/1987 | Japan | 271/251 |
| 300043 | 12/1988 | Japan | 271/225 |
| 81742 | 3/1989 | Japan | 271/250 |
| 28447 | 1/1990 | Japan | 271/251 |

OTHER PUBLICATIONS

Kroeker, "Cone Roller Couple", Mar. 1983, IBM Technical Disclosure Bulletin, vol. 25, No. 10, p. 5138.

Lamds, "Aligning Sheet Feeder", Sep. 1977, IBM Technical Disclosure Bulletin, vol. 20, No. 4, p. 1295.

*Primary Examiner*—Robert P. Olszewski

*Assistant Examiner*—Boris Milef

*Attorney, Agent, or Firm*—Fitzpatrick, Cella, Harper & Scinto

[57] ABSTRACT

The present invention provides a sheet feeding apparatus having a sheet regulating member arranged along a sheet feeding path, for regulating a lateral position of a sheet material perpendicular to the sheet feeding path by urging the lateral edge of the sheet material against the sheet regulating member, and sheet feed rollers for feeding the sheet material along the sheet feeding direction and for applying to the sheet material a rotational moment tending to urge the lateral edge of the sheet material against the sheet regulating member, whereby the sheet material is fed without occurring the skew-feed thereof.

30 Claims, 6 Drawing Sheets

APPARATUS AND METHOD FOR ALIGNING A SHEET AGAINST A SIDE REGISTRATING MEMBER USING PLURAL ALIGNMENT DEVICES

This application is a continuation of application Ser. No. 07/436,031 filed Nov. 14, 1989, now abandoned.

BACKGROUND OF THE INVENTION

1. Field of the Invention

The present invention relates to a sheet feeding apparatus applied to an image forming system such as a copying machine, printer and the like, and more particularly, it relates to a sheet feeding apparatus which feeds a sheet material by means of a plurality of rollers or an elongated roller.

2. Related Background Art

In the past, as a sheet feeding apparatus of this kind, an apparatus as shown in FIG. 6 has already been known. This conventional sheet feeding apparatus comprises three rubber feed rollers 101, 102 and 103 having the same diameter and attached to a common driving shaft 100 and can feed a sheet material $S_o$ in a direction shown by the arrow $A_o$ by rotating the driving shaft 100 by a motor (not shown). Further, in this conventional sheet feeding apparatus, a lateral registering plate 104 is arranged on one side of a sheet feeding path upstream of the driving shaft to prevent the skew-feed of the sheet material $S_o$. In this way, the sheet material $S_o$ is prevented from shifting to the lateral direction by means of the lateral registering plate 104 and is fed by the rotational movement of the feed rollers 101–103 toward a registering roller 105 at that atitude. Such sheet feeding apparatus is also disclosed in the U.S. Pat. No. 4,098,551.

However, in such conventional sheet feeding apparatus, when the rubber feed rollers 101–103 are used for a long time, the diameters of these rollers change from each other due to uneven wear, with the result that there arises the difference in feeding speeds of the sheet material $S_o$ at the respective feed rollers 101–103.

For example, if the feed roller 103 remote from the lateral registering plate 104 wears more than the feed roller 101 near the lateral registering plate 104, the outer diameter of the feed roller 101 near the lateral registering plate 104 will be larger than that of the feed roller 103, and accordingly, the feeding speed of the feed roller 101 will also be faster than that of the feed roller 103. Accordingly, the leading portion of the sheet material $S_o$ is subject to a force directing to a direction $P_1$, whereas the trailing portion of the sheet material is subject to a force directing to a direction $P_2$. In this case, however, since the sheet material $S_o$ is regulated by the lateral registering plate 104, the sheet material is not skew-fed at an upstream side of the feed rollers 101–103. Further, since the leading edge of the sheet material $S_o$ is pinched by the registering roller 105 before the trailing edge of the sheet material leaves the lateral registering plate 104, the sheet material is also not skew-fed at a downstream side of the feed rollers.

To the contrary, if the feed roller 101 near the lateral registering plate 104 wears more than the feed roller 103 remote from the lateral registering plate 104, the leading portion of the sheet material $S_o$ will be subject to a force directing to a direction $P_3$ and the trailing portion of the sheet material will be subject to a force directing to a direction $P_4$ for the same reason as mentioned above. In this case, since there is no lateral registering plate (for preventing the skew-feed of the sheet material $S_o$) at the opposite side of the sheet feeding path, the sheet material $S_o$ will be gradually skew-fed in the direction $P_4$.

As mentioned above, in the conventional sheet feeding apparatus, since the skew-feed of the sheet material was caused by the uneven wear of the feed rollers, even if the feed rollers could still be used, the feed rollers had to be replaced by new ones a little earlier, thus forcing the excessive labor upon an operator.

SUMMARY OF THE INVENTION

An object of the present invention is to provide a sheet feeding apparatus which can eliminate the above-mentioned conventional drawback and which can prevent the skew-feed of a sheet material for a long time.

In order to achieve the above object, the present invention provides a sheet feeding apparatus including feed roller means for feeding a sheet material and a sheet regulating member arranged at one side of a sheet feeding path for regulating a lateral position of the sheet material by engaging with a lateral side of the sheet material, and wherein a sheet feeding speed at a portion of the feed roller means near the sheet regulating member is differentiated from a sheet feeding speed at a portion of the feed roller means remote from the sheet regulating member, in accordance with a positional relation between the feed roller means and the sheet regulating member in a sheet feeding direction, so as to generate a moment tending to abut the sheet material against the sheet regulating member.

Generally, in an apparatus for feeding the sheet material by the use of feed roller means, when a sheet feeding speed at a feed roller portion near a sheet regulating member is different from that at a feed roller portion remote from the sheet regulating member, the sheet material is subject to a force tending to rotate or turn the sheet material around the feed roller portion having the slower sheet feeding speed.

Therefore, as in the present invention, when the sheet feeding speeds are differentiated in accordance with the positional relation between the feed roller means and the sheet regulating member in the sheet feeding direction, it is possible to feed the sheet material while always abutting the sheet material against the sheet regulating member. In this case, even if the outer diameter of the feed roller portion having the faster sheet feeding speed gradually becomes smaller than the outer diameter of the feed roller portion having the slower sheet feeding speed due to the wear of the feed roller means during the long use of the sheet feeding apparatus, the sheet feeding speeds on both sides of the feed roller means are not reversed readily, thus considerably differing the occurrence of the skew-feed of the sheet material.

Incidentally, the U.S. Pat. No. 4,374,586 discloses a sheet feeding apparatus which can feed a sheet while applying a rotational moment to the sheet by designing that a sheet feeding speed of feed rollers acting on both sides of the sheet is faster than a sheet feeding speed of a feed roller acting on a central portion of the sheet. However, the rotational moment is not for pressing the sheet against a guide member but for feeding the sheet in an inclined atitude. Accordingly, this conventional sheet feeding apparatus differs from the present invention.

DETAILED DESCRIPTION OF THE PREFERRED EMBODIMENTS

The present invention will now be explained in connection with embodiments thereof with reference to the accompanying drawings.

Figure 1:
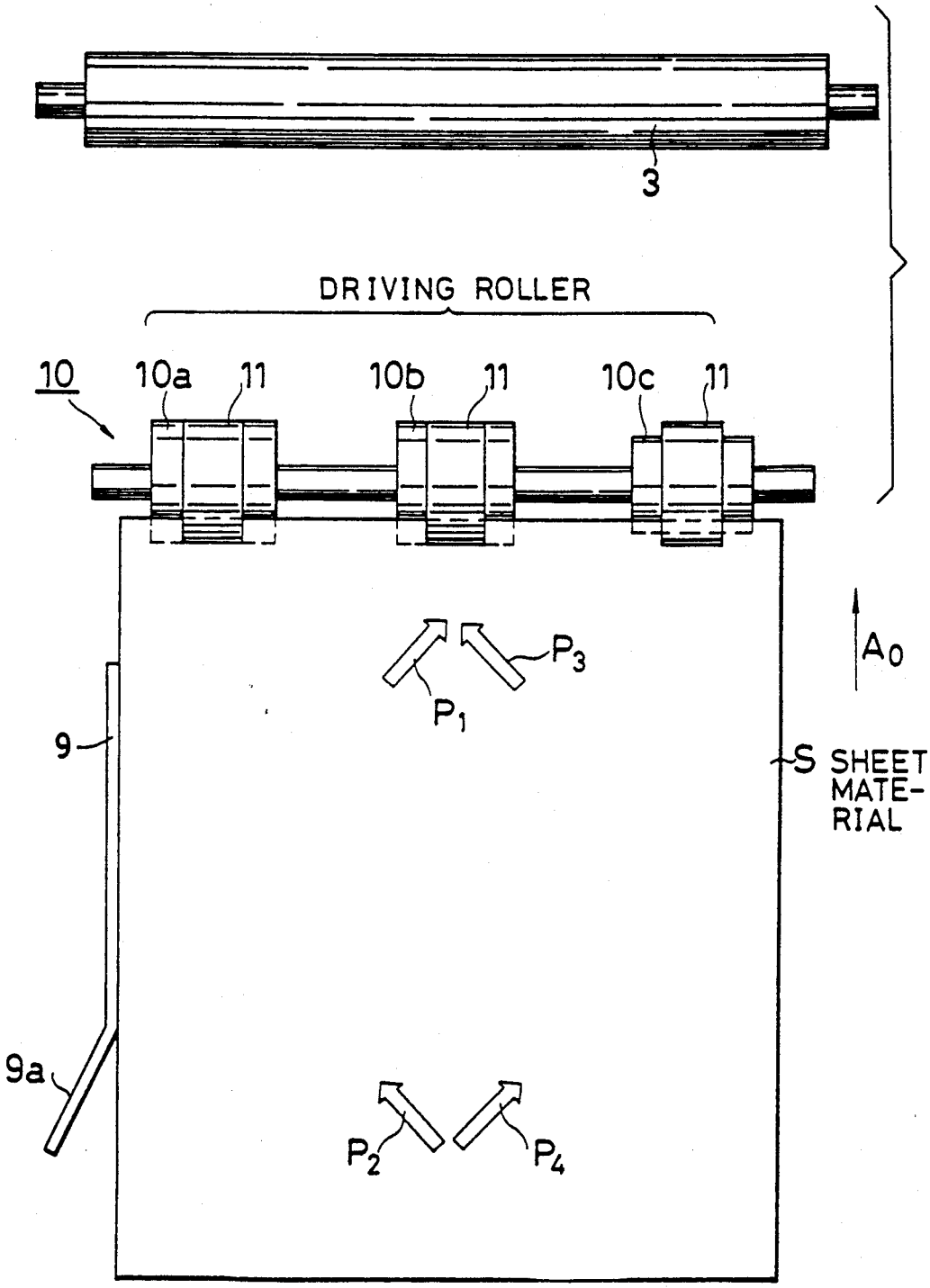
FIG. 1 is a plan view of a main portion of a sheet feeding apparatus according to a preferred embodiment of the present invention.
Figures 2A, 2B:
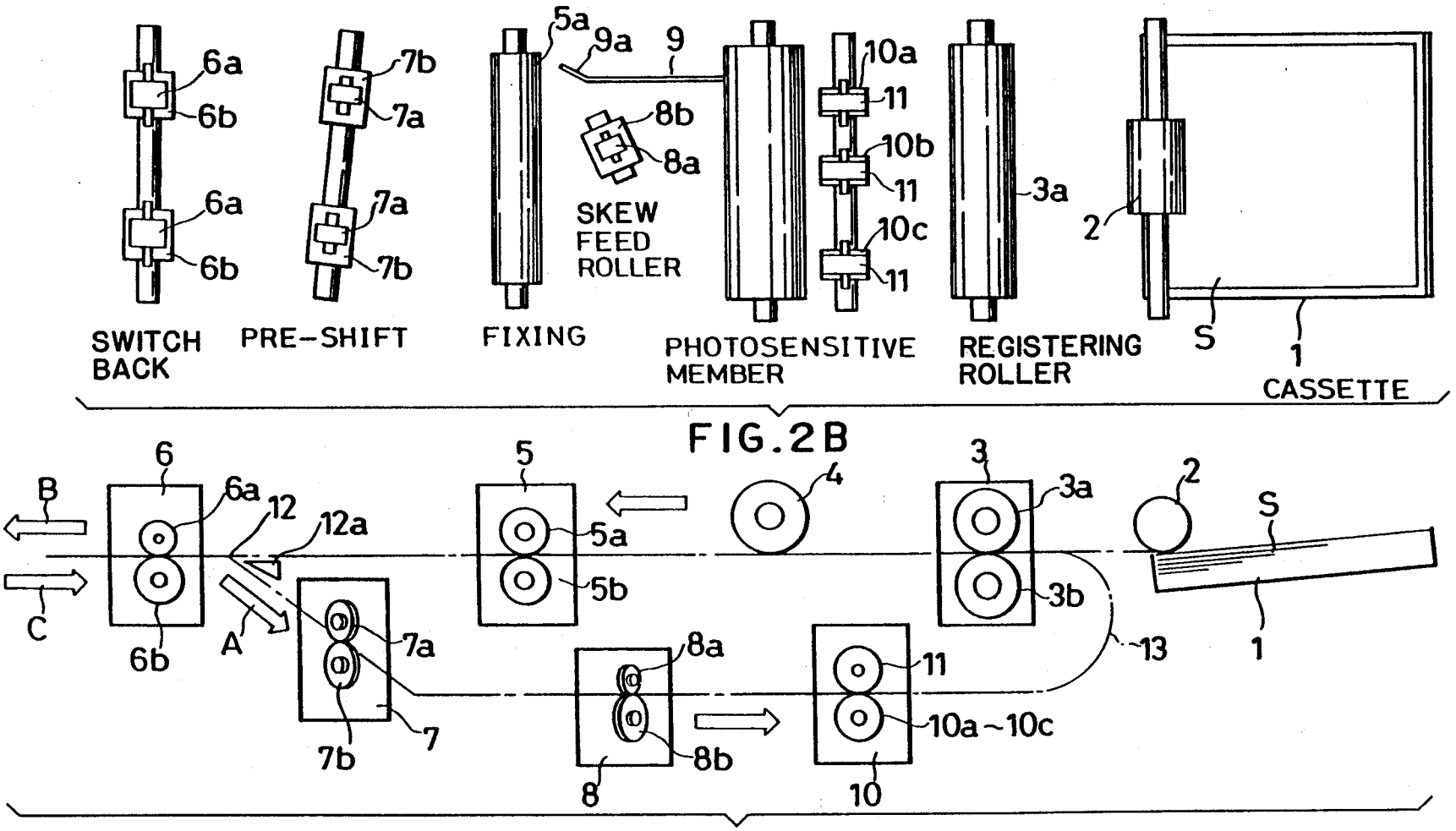
FIG. 2A is a schematic plan view of a recording system incorporating the sheet feeding apparatus of FIG. 1.
FIG. 2B is a schematic elevational view of the recording system of FIG. 2A.

FIG. 1 shows a sheet feeding apparatus according to an embodiment of the present invention, and FIGS. 2A and 2B show an example of a recording system incorporating the sheet feeding apparatus of FIG. 1. The recording system can form an image electrophotographically and serves to form the images on both surfaces of the sheet material S.

As shown in FIGS. 2A and 2B, the recording system includes a cassette 1 for accommodating the sheets S. The sheets S are fed out one by one from the cassette 1 by means of a sheet feeding roller 2. Downstream of the sheet feeding roller 2 in a sheet feeding direction, there are arranged a pair 3 of registering rollers 3*a* which serve to feed the sheet material S at a predetermined timing to a photosensitive drum 4 rotating at a constant speed.

Incidentally, around the photosensitive drum 4, a primary charger, a transfer charger, a developing device, a cleaner and the like (not shown) are arranged in a conventional manner. Further, downstream of the photosensitive drum 4 in the sheet feeding direction, there are arranged a pair 5 of fixing rollers 5*a*, 5*b* for fixing a toner image transferred to the sheet material S.

In the recording system, to record the images on both surfaces of the sheet material S, there is provided a sheet turning-over mechanism comprising a switchback means 6, a pre-shift roller means 7, a skew-feed roller means 8, a lateral registering plate 9 and re-feed roller means 10.

The switchback means 6 is arranged downstream of the fixing roller pair 6 in the sheet feeding direction and comprises two pairs of reversible rollers 6*a*, 6*b*, and a change-over flapper 12*a* for directing the sheet material S switchbacked by the reversible rollers to the pre-shift roller means 7 (in a direction A).

The pre-shift roller means 7 comprises two pairs of parallel rollers 7*a*, 7*b*. Rotary shafts for these rollers 7*a*, 7*b* are inclined with respect to the lateral registering plate 9 as shown in FIG. 2A.

The skew-feed roller means 8 comprises two pairs of rollers 8*a*, 8*b* similar to the rollers 7*a*, 7*b*. Rotary shafts for these rollers 8*a*, 8*b* are inclined toward the lateral registering plate 9 arranged at the left side (FIG. 1) of the sheet feeding direction, so that the sheet material S is abutted against the lateral registering plate 9 by means of these rollers 8*a*, 8*b*. Incidentally, the lateral registering plate 9 is provided at its free end with a chamfered portion 9*a* for smoothly guiding the sheet material S.

The re-feed roller means 10 comprises three lower driving feed rollers 10*a*, 10*b*, 10*c* and three upper pressure rollers 11 for pressing the sheet material S against the driving rollers 10*a*–10*c*. The sheet material S is fed again to the registering roller pair 3 by the re-feed roller means 10.

With the arrangement as mentioned above, when the images are recorded on both surfaces of the sheet material S, the sheet material S fed from the cassette 1 by means of the sheet feeding roller 2 is directed to the registering roller pair 3, by which the sheet material S is fed to the photosensitive drum 4 at the predetermined timing. After the image has been formed on one surface of the sheet material, the sheet material is fed to the fixing roller pair 5, where the image is fixed to the sheet material, and thereafter, the sheet material is fed to the switchback means 6.

In the switchback means 6, when the trailing edge of the sheet material reaches a switchback point 12, the rotation of the reversible rollers 6*a*, 6*b* which has served to feed the sheet material to a direction B is reversed to serve to feed the sheet material to a direction C and at the same time the change-over flapper 12*a* is changed over to open the sheet feeding path to the direction A, thereby feeding the sheet material S in the direction A. In this case, the sheet material S is fed by the pre-shift roller means 7. Since the rotary shafts of the pre-shift rollers 7*a*, 7*b* are inclined away from the lateral registering plate 9, the sheet material is skew-fed away from the lateral registering plate 9 thus preventing the sheet material from striking against the chamfered portion 9*a* of the lateral registering plate. Then, the sheet material is skew-fed oppositely by the skew-feed roller means 8*a*, 8*b* to abut against the lateral registering plate 9, thereby positioning the lateral edge of the sheet material. Thereafter, the sheet material S is introduced into the registering roller pair 3 by the re-feed roller means 10.

In this way, the sheet is overturned to face the second or non-recorded surface to the upside. Then, the image is formed on the second surface of the sheet material in the same manner as mentioned above. Thereafter, the sheet material S is ejected through the switchback means 6 to the direction B and is collected onto an ejector tray (not shown). In this way, the recording of the images on both surfaces of the sheet material is completed.

By the way, in the above-mentioned re-feed roller means 10, the driving feed rollers 10*a*–10*c* made of rubber are used for feeding the sheet material S. However, since the pressure rollers 11 are pressed against these driving feed rollers 10*a*–10*c*, for example, by means of springs, it is actually impossible to wear all of the driving feed rollers evenly or uniformly.

For example, if the driving feed roller 10*c* remote from the lateral registering plate 9 wears more than the driving feed roller 10*a* near the lateral registering plate 9 with the result that the diameter of the roller 10*a* is larger than that of the roller 10*c*, the sheet feeding speed of the roller 10*a* will be faster than that of the roller 10*c*. However, in this case, since the lateral movement of the sheet material S is regulated by the lateral registering plate 9, the skew-feed of the sheet material does not occur.

However, to the contrary, if the driving feed roller 10*a* wears more than the driving feed roller 10*c*, since there is no sheet regulating means on the other side of the sheet feeding path (opposite to the lateral registering plate 9), the sheet material S will be skew-fed.

To avoid this, in the illustrated embodiment, as shown in FIG. 1, the diameter of the driving roller 10*c* remote from the lateral registering plate 9 previously makes smaller than the diameters of the other driving rollers 10*a*, 10*b*, so that, even if the driving roller 10*a* wears more than the driving roller 10*c* for some reasons, the skew-feed of the sheet material S can be prevented until the diameter of the driving roller 10*a* becomes smaller than that of the driving roller 10*c*.

More particularly, if it is assumed that the diameters of the driving rollers 10*a*, 10*b* and 10*c* are Da, Db and Dc, respectively, since the diameter Da is the same as the diameter Db and is larger than the diameter Dc initially, the leading portion of the sheet material S is subject to the force $P_1$ and the trailing portion of the sheet material is subject to the force $P_2$. However, in this case, since the lateral movement of the sheet material S is regulated by the lateral registering plate 9, the sheet material S is not skewed but is fed to the direction $A_o$. Since the sheet feeding speed of the driving roller 10*c* is slower than those of the driving rollers 10*a*, 10*b*, the sheet material is subject to a moment tending to rotate the sheet material in an anticlockwise direction (FIG. 1) around an intermediate point between the rollers 10*a* and 10*b*. With this moment, the sheet material S is fed while being urged against the lateral registering plate 9 downstream of the re-feed roller means 10, thus preventing the skew-feed of the sheet material.

On the other hand, if the driving roller 10*a* near the lateral registering plate 9 wears more than the driving roller 10*c* to make the diameter Da smaller than the diameter Dc, since the sheet material S is subject to the forces $P_3$, $P_4$, the sheet material S will be skew-fed toward the direction $P_4$.

However, in the illustrated embodiment, it is previously designed so that the diameter Da is larger than the diameter Dc. It should be noted that the time from the condition that the diameter Da is larger than the diameter Dc till the condition that the diameter Da becomes smaller than the diameter Dc is apparently longer than the time from the condition that the diameter Da is equal to the diameter Dc till the condition that the diameter Da becomes smaller than the diameter Dc. Accordingly, even if the driving roller 10*a* wears more than the driving roller 10*c* for some reasons, it is possible to maintain the relation that the diameter Da is larger than or equal to the diameter Dc for a long time, thus differing the occurrence of the skew-feed of the sheet material S.

In the illustrated embodiment, as shown in FIG. 2B, since the sheet feeding path 13 from the re-feed roller means 10 to the registering roller pair 3 is relatively short and the relatively large sheet feeding force is required, the re-feed roller means 10 is constituted by three driving rollers 10*a*–10*c*. However, in the sheet feeding apparatus which does not need such a large sheet feeding force, since the sheet material can be fed adequately by two driving rollers, the re-feed roller means may be constructed by two driving rollers 10*a* and 10*c* (i.e., the central driving roller 10*b* may be omitted). Also in this case, theoretically, it is possible to completely prevent the skew-feed of the sheet material S due to the wear of the rollers.

Figure 3:
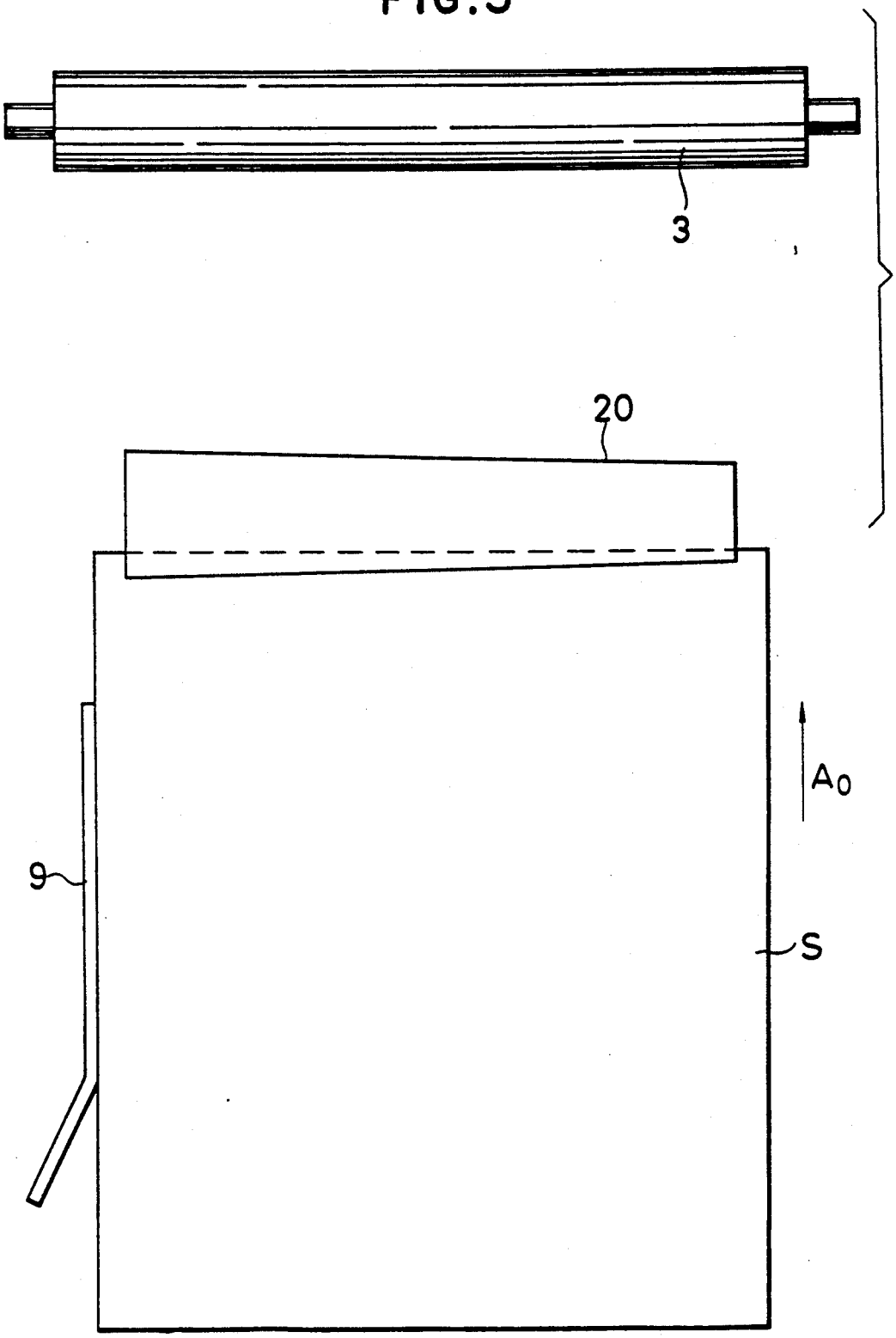
FIG. 3 is a plan view of a main portion of a sheet feeding apparatus according to another embodiment of the present invention.

Alternatively, when the sheet material S is fed by an elongated roller, as shown in FIG. 3, a tapered roller 20 having a larger diameter near the lateral registering plate 9 and a smaller diameter remote from the lateral registering plate may be used. With this arrangement, since the feeding speed of the smaller diameter end portion of the roller 20 is slower than the feeding speed of the larger diameter end portion of the roller, the sheet material is subject to a moment tending to rotate the sheet material in a clockwise direction (FIG. 3). By this moment, the sheet material S is fed while urging the lateral edge thereof against the lateral registering plate 9, thus preventing the occurrence of the skew-feed of the sheet material. Also in this case, as in the previous embodiment, the skew-feed of the sheet material S can be prevented for a long time.

Figure 4:
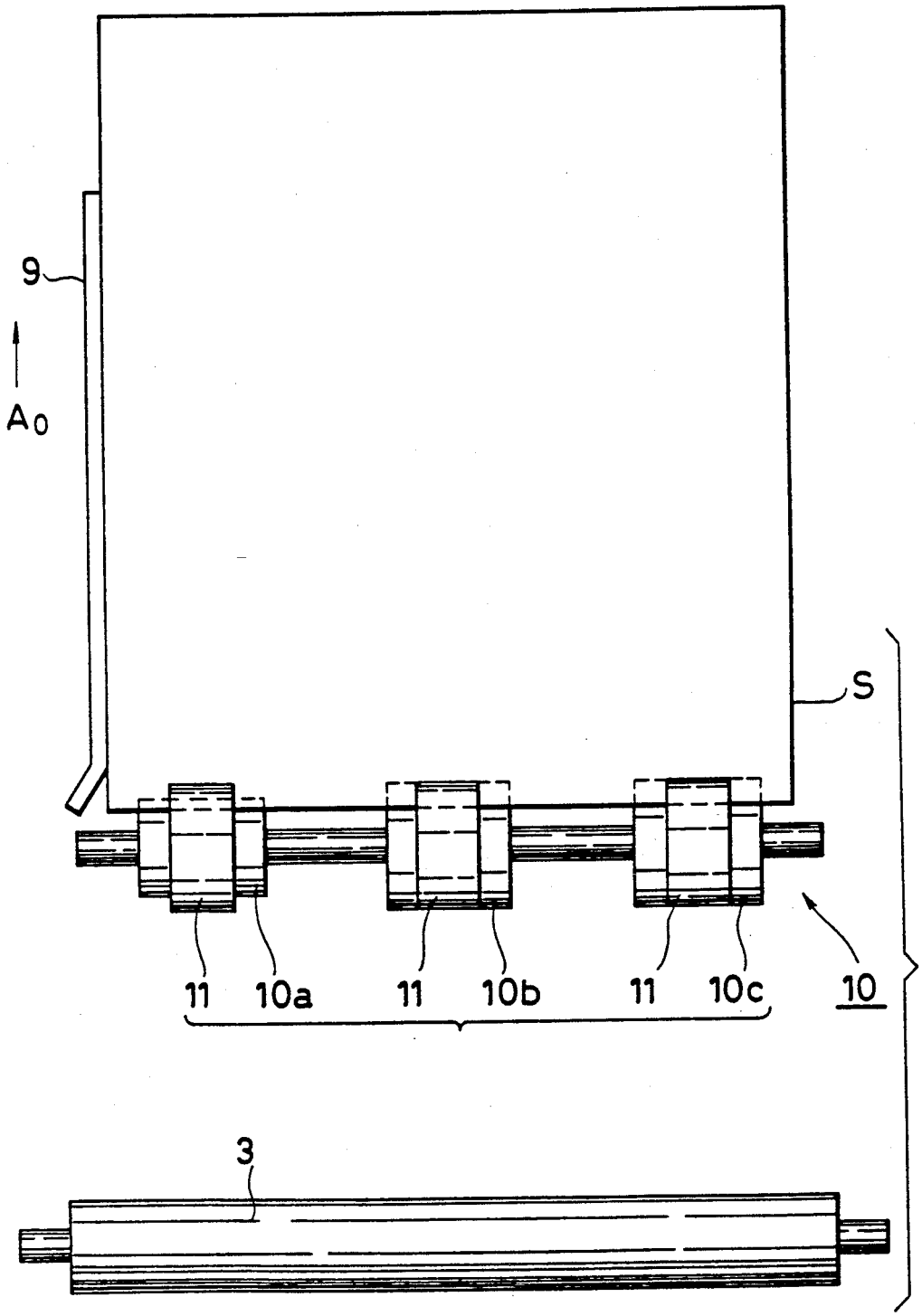
FIGS. 4 and 5 are schematic plan views showing further embodiments of the present invention.

Incidentally, in the sheet feeding apparatus wherein the lateral registering plate is arranged downstream of the feed roller in the sheet feeding direction, the re-feed roller means may be arranged in such a manner that the larger diameter driving roller is positioned remotely from the lateral registering plate and the smaller diameter driving roller is arranged near the lateral registering plate. Also in this case, the same technical effect as mentioned above can be obtained. For example, in a re-feed roller means 10 as shown in FIG. 4, the diameters Da, Db, Dc of the driving rollers 10*a*, 10*b*, 10*c* have a relation that the diameter Da is smaller than the diameter Db and the diameter Dc is equal to the diameter Db. In this case, since the sheet feeding speed of the driving roller 10*a* is slower than those of the other driving rollers 10*b*, 10*c*, the sheet material S is subject to a moment tending to rotate the sheet material in an anticlockwise direction (FIG. 4). By this moment, the sheet material S is fed in the direction $A_o$ while being urged against the lateral registering plate 9, thus preventing the skew-feed of the sheet material.

Figure 5:
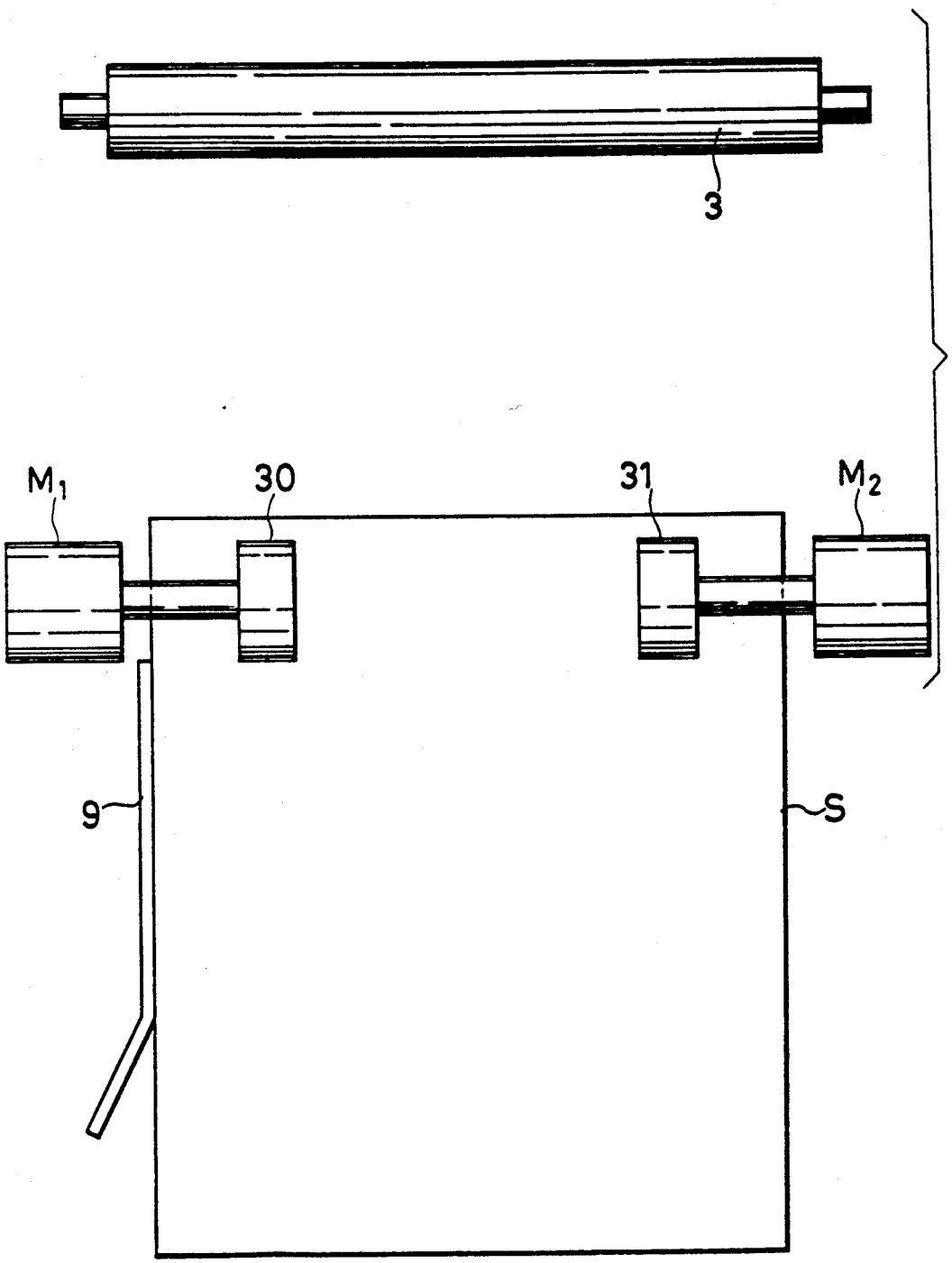
Figure 6:
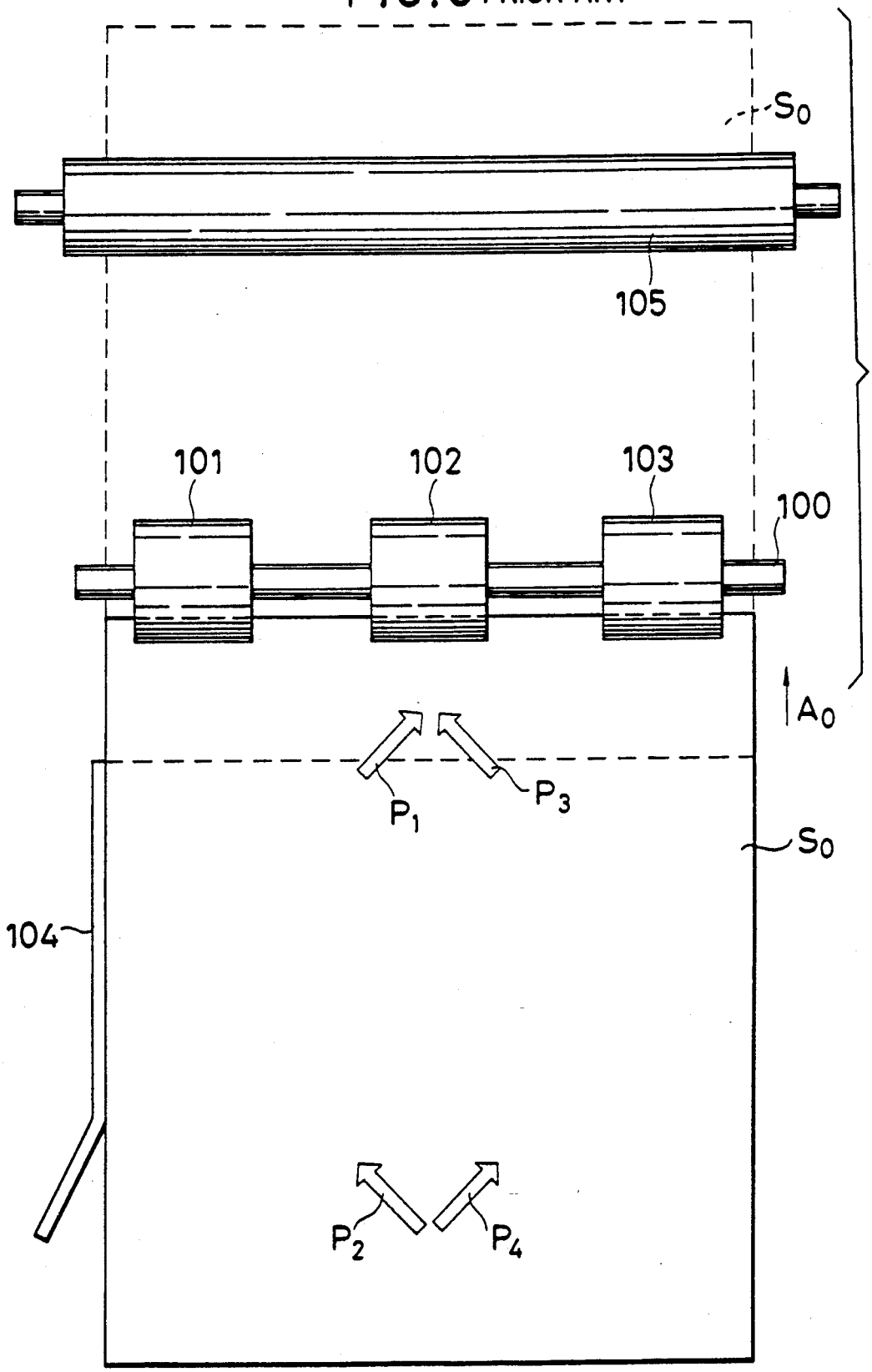
FIG. 6 PRIOR ART
FIG. 6 is a plan view of a main portion of a conventional sheet feeding apparatus.

Alternatively, as shown in FIG. 5, two driving rollers 30 and 31 may be arranged to act on both lateral edge portions of the sheet material S. In this case, the driving rollers 30, 31 are driven by discrete motors $M_1$, $M_2$, respectively, so that the driving roller 31 remote from the lateral registering plate 9 is rotated at a speed slower than a rotational speed of the driving roller 30 near the lateral registering plate 9. Also in this embodiment, the same technical effect as mentioned above can be obtained. Alternatively, only one motor may be used for rotating the driving rollers 30, 31 and the rotational speeds of these rollers may be differentiated through an appropriate reduction gear.

Incidentally, in the illustrated embodiments, while the present invention was applied to the refeed roller means 10, the present invention can be applied to other roller arrangements. Further, the present invention is applicable to not only the above-mentioned recording system but also various systems.

As mentioned above, according to the present invention, even if the feed rollers wear unevenly the prompt skew-feed of the sheet material can be prevented, thus preventing the occurrence of the skew-feed of the sheet material for a long time.

What is claimed is:

1. A sheet feeding apparatus, comprising:

a sheet registering member for registering a position of a sheet by having a side edge of the sheet abutted thereto as the sheet is fed in a predetermined direction;

a first feed means for feeding the sheet in a predetermined direction without applying a rotational moment and with urging against said sheet registering member; and a second feed means, arranged downstream of said first feed means in the predetermined direction, for applying a rotational moment to the sheet urging the sheet against said sheet registering member as the sheet is fed in the predetermined direction.

2. A sheet feeding apparatus according to claim 1, wherein said second feed means includes a rotary member whose diameter varies in an axial direction thereof.

3. An image forming apparatus according to claim 2, wherein the axial direction of said rotary member makes a predetermined angle relative to the predetermined direction.

4. An image forming apparatus according to claim 3, wherein a diameter of said rotary member increases toward said registering member.

5. A sheet feeding apparatus according to claim 1, wherein said registering member is located upstream of said second feed means in the sheet feeding direction.

6. A sheet feeding apparatus according to claim 1, wherein said second feed means has plural rotational members for applying a feed force to the sheet.

7. A sheet feeding apparatus according to claim 6, wherein the rotational member arranged nearest from said sheet registering member has a peripheral speed faster than that of the rotational member arranged furthest to said registering member, among said plural rotational members.

8. A sheet feeding apparatus according to claim 6, wherein the rotational member arranged nearest to said sheet registering member has diameter larger than that of the rotational member arranged furthest from said registering member, among said plural rotational members.

9. A sheet feeding apparatus according to claim 7, further including a first drive source for driving the rotary member nearest to said registering member, and a second drive source for driving the rotary member furthest from said registering member.

10. A sheet feeding apparatus, comprising:

a sheet registering member for registering a position of a sheet by having a side edge of the sheet abutting thereto as the sheet is fed in a predetermined direction;

a first feed means for feeding the sheet in a predetermined direction without applying a rotational moment and with urging against said sheet registering member;

a second feed means, arranged downstream of said first feed means in the predetermined direction, for applying rotational moment to the sheet urging the sheet against said sheet registering member as the sheet is fed in the predetermined direction; and a third feed means, arranged upstream of said first feed means in the sheet feed direction, for applying a feed force in the predetermined direction, while applying a feeding force in a direction remoting said registering member.

11. A sheet feeding apparatus according to claim 10, wherein said second feed means has plural rotational members for applying a feed force to the sheet.

12. A sheet feeding apparatus according to claim 10, wherein said registering member is located upstream of said second feed means in the sheet feeding direction.

13. A sheet feeding apparatus according to claim 11, wherein the rotational member arranged nearest from said sheet registering member has peripheral speed faster than that of the rotational member arranged furthest to said registering member, among said plural rotational members.

14. A sheet feeding apparatus according to claim 11, wherein the rotational member arranged nearest to said sheet registering member has diameter larger than that of the rotational member arranged furthest from said registering member, among said plural rotary members.

15. An image forming apparatus, comprising:

an image formation means for forming an image on a sheet;

a sheet registering member for registering a position of a sheet by having a side edge of the sheet abutted thereto as the sheet is fed in a predetermined direction;

a first feed means for feeding the sheet on which the image is formed by said image formation means in the predetermined direction without applying a rotational moment and with urging against said registering member;

a second feed means, arranged downstream of said first feed means in the sheet feed direction, for feeding the sheet in the predetermined direction with applying a rotational moment in a direction urging the sheet against said sheet registering member;

a first feed path for introducing the sheet on which the image is formed by said image formation means to said first feed means; and a second feed path for feeding the sheet fed by said second feed means to said image formation means.

16. A sheet feed method, comprising steps of:

abutting a side edge of a sheet against a registering member, said registering member provided for registering a position of a sheet by having a side edge of the sheet abut the registering member as the sheet is fed in a predetermined direction; and applying a rotational moment having a center located downstream of said registering member in the predetermined direction and operating in a direction tending to press a tip end of the sheet side edge against the registering member and feed the sheet in the predetermined direction.

17. A sheet feed method, comprising steps of:

feeding a sheet to a registering member provided for registering a position of a sheet by having a side edge of the sheet to be fed in a predetermined direction from downstream side in a sheet feed direction so that a tip end of the sheet does not abut against the registering member;

bringing the sheet side edge into abutment against the registering member; and applying a rotational moment having a center located downstream of said registering member in the predetermined direction and feeding the sheet in the predetermined direction, said rotational moment for pressing the side edge of the sheet against said registering member.

18. An image forming apparatus, comprising:

image formation means for forming an image on a sheet;

a sheet registering member for registering a position of a sheet by having a side edge of the sheet abutted thereto as the sheet is fed in a predetermined direction;

first feed means for feeding the sheet in the predetermined direction without applying a rotational moment and with urging against said sheet registering member;

second feed means, arranged downstream of said first feed means in the predetermined direction, for applying a rotational moment to the sheet urging the sheet against said sheet registering member as the sheet is fed in the predetermined direction; and a guide path for guiding the sheet fed by said second feed means to said image formation means.

19. A sheet feeding apparatus, comprising:

a regulation member for regulating a position of side edge of a sheet fed in a predetermined direction;

align means for aligning the sheet by having the sheet abutted against said regulation member; and feed means disposed downstream of said regulation member and align means in the predetermined direction, for feeding the sheet in the predetermined direction with applying a rotational moment urging the sheet side edge against said regulation member.

20. A sheet feeding apparatus according to claim 19, wherein said align means has a pair of rollers for feeding the sheet in a direction oblique to the predetermined direction.

21. A sheet feeding apparatus according to claim 19, wherein said feed means has plural rotary members for applying a feed force to the sheet by rotating in contact with the sheet.

22. A sheet feeding apparatus according to claim 21, wherein, among said plural rotary members, the rotary member nearest from said regulation member has higher peripheral speed than the rotary member furthest to said regulation member.

23. A sheet feeding apparatus according to claim 22, wherein, among said plural rotary members, the rotary member nearest to said regulation member has larger radius than the rotary member furthest from said regulation member.

24. A sheet feeding apparatus according to claim 22, further having first drive means for driving the rotary member furthest from said regulation member, and second drive means for driving the rotary member nearest to said regulation member.

25. A sheet feeding apparatus according to claim 19, wherein said feed means includes a rotary member whose diameter varies in an axial direction thereof.

26. A sheet feeding apparatus according to claim 25, wherein the axial direction of said rotary member makes a predetermined angle relative to the predetermined direction.

27. A sheet feeding apparatus according to claim 26, wherein the diameter radius of said rotary member increases toward said regulation member.

28. An image forming apparatus, comprising:

a regulation member for regulating a position of a side edge of a sheet fed in a predetermined direction;

align means for aligning the sheet by having the sheet abutted against said regulation member;

feed means, disposed downstream of said regulation member and said align member in the predetermined direction, for feeding the sheet in the predetermined direction with applying a rotational moment urging the sheet side edge against said regulation member; and image formation means for forming an image on the sheet fed by said feed means.

29. An image forming apparatus according to claim 28, further including a first feed path for introducing the sheet on which the image is formed by said image formation means to said align means.

30. An image forming apparatus according to claim 29, further including a second feed path for introducing the sheet fed by said feed means to said image formation means.

* * * * *

UNITED STATES PATENT AND TRADEMARK OFFICE

CERTIFICATE OF CORRECTION

PATENT NO. : 5,167,409

DATED : December 1, 1992

INVENTOR(S) : HIGETA

It is certified that error appears in the above-identified patent and that said Letters Patent is hereby corrected as shown below:

On the title page,

[54] TITLE and Column 1, line 2,

Line 3, "REGISTRATING" should read --REGISTERING--.

[56] REFERENCES CITED

OTHER PUBLICATIONS
"Lamds," should read --Lamos,--.

COLUMN 1

Line 2, "REGISTRATING" should read --REGISTERING--.

COLUMN 7

Line 11, "An image forming apparatus" should read --A sheet feeding apparatus--.
Line 15, "An image forming apparatus" should read --A sheet feeding apparatus--.
Line 28, "to" should read --from--.

UNITED STATES PATENT AND TRADEMARK OFFICE

CERTIFICATE OF CORRECTION

PATENT NO. : 5,167,409

DATED : December 1, 1992

INVENTOR(S) : HIGETA

It is certified that error appears in the above-identified patent and that said Letters Patent is hereby corrected as shown below:

COLUMN 8

Line 2, "to" should read --from--.
Line 8, "rotary" should read --rotational--.
Line 47, "registering" should read --registering of--.

COLUMN 9

Line 35, "to" should read --from--.

COLUMN 10

Line 24, "align member" should read --align means--.

Signed and Sealed this

Seventh Day of December, 1993

Bruce Lehman

*Attest:*

BRUCE LEHMAN

*Attesting Officer*

*Commissioner of Patents and Trademarks*